US005952091A

United States Patent [19]

Horand et al.

[11] Patent Number: 5,952,091

[45] Date of Patent: Sep. 14, 1999

[54] WEB PRINTING PAPER COATED ON BOTH SIDES AND PROCESS FOR ITS MANUFACTURE

[75] Inventors: Dieter Horand, Niederkrüchten; Adam Gürtler, Düsseldorf; Bernd Pelech, Viersen; Paul-Heinz Dähling, Elsdorf-Esch, all of Germany

[73] Assignee: Stora Feldmühle AG, Düsseldorf, Germany

[21] Appl. No.: 08/722,248

[22] PCT Filed: Apr. 7, 1995

[86] PCT No.: PCT/EP95/01283

§ 371 Date: Sep. 30, 1996

§ 102(e) Date: Sep. 30, 1996

[87] PCT Pub. No.: WO95/27824

PCT Pub. Date: Oct. 19, 1995

[30] Foreign Application Priority Data

Apr. 8, 1994 [DE] Germany ..... 44 11 987

[51] Int. Cl.[6] ..... D21H 19/38; B05D 5/04; B32B 5/16

[52] U.S. Cl. ..... 428/323; 428/330; 428/331; 428/340; 428/342; 428/537.5; 162/135; 162/147; 162/181.1; 427/209; 427/361; 427/395

[58] Field of Search ..... 428/323, 340, 428/341, 342, 537.5, 330, 331; 162/135, 137, 147, 181.1; 427/209, 361, 395

[56] References Cited

U.S. PATENT DOCUMENTS

| | | | |
|---|---|---|---|
| 3,714,107 | 1/1973 | Smith . | |
| 4,241,142 | 12/1980 | Kaliski et al. | 428/511 |
| 4,948,664 | 8/1990 | Brociner | 428/331 |
| 5,120,365 | 6/1992 | Kogler | 106/415 |
| 5,501,774 | 3/1996 | Burke | 162/164.1 |
| 5,609,964 | 3/1997 | Ogawa et al. | 428/520 |
| 5,753,077 | 5/1998 | Horand et al. | 162/135 |

*Primary Examiner*—Marie Yamnitzky
*Attorney, Agent, or Firm*—Cohen, Pontani, Lieberman, Pavane

[57] ABSTRACT

A web printing paper, including a coating base paper which contains mineral filler and at least one of wood pulp and cellulose as fiber components. The coating base paper has a grammage of 30 to <58 g/m$^2$, and a filler content, relative to its grammage, equal to 15 to 35% by weight. The coating base paper selectively contains, in addition to the at least one of wood pulp and cellulose, up to <50% by weight recycled fibers, all weight parts adding up to 100% by weight. The printing paper further includes a coating applied to both sides of the base paper by a film press so as to absorb printing ink. The coating contains pigment and binder. The coating on each side of the base paper has a grammage of 2 to 12 g/m$^2$, and the pigment of the coating has a grain size, 40 to 60% by weight, of <2 $\mu$m.

10 Claims, No Drawings

WEB PRINTING PAPER COATED ON BOTH SIDES AND PROCESS FOR ITS MANUFACTURE

BACKGROUND OF THE INVENTION

1. Field of the Invention

The present invention relates to a web printing paper coated on both sides, consisting of a coating base paper that contains mineral filler and, as fiber components, wood pulp and/or cellulose. The coating, which contains pigment and binder and serves to absorb the printing ink, is applied by means of a film press. The invention also relates to a process for manufacturing the web printing paper.

2. Description of the Prior Art

Web printing papers of the aforementioned type are used in the production of periodicals, especially illustrated periodicals, magazines, catalogs and advertising brochures, such as those normally inserted into daily newspapers or illustrated periodicals.

Numerous attempts have already been made to reduce production costs for the papers in question, particularly by reducing the grammage of the coating base paper or by replacing the cellulose and/or wood pulp fibers with recycled fibers.

An overview of the offset papers containing wood that are commonly used in Europe is found in the article "Study of Binder Systems for LLWC and MFP Papers" ("*Studie ueber Bindemittelsysteme fuer LLWC and MFP Papers*") published in the "Paper Manufacturing Weekly" ("*Wochenblatt fuer Papierfabrikation*") 9 (1988), pp. 337 to 344. This article also describes a film press used to apply preparations to the paper types in question. The described pigment composition consists of a mixture of 60 parts of English China Clay and 40 parts of a fine American kaolin. The authors of this article conclude that when an SD coater (short dwell time coating device) is used, 20 parts by weight of binder are required for an application of 5 g/m$^2$, while 30 parts by weight are needed for an application of 3 g/m$^2$. However, if a film press is used instead of an SD coater, it is considered necessary to increase the binder level in order to achieve the same printing gloss, albeit with lower opacity.

In the "Paper Manufacturing Weekly" 16 (1990), pp. 701 to 708, and "Pulp and Paper Canada" 92:4 (1991) pp. 52–58, there are reports on the surface treatment of newsprint paper by means of a film press. In these studies, a base paper was used that had an ash content of only 0.4% by weight. No information is given about the fineness of the pigments used for the surface treatment. In the formulas used for the surface pigmentation, the extraordinarily high binder content of 70% by weight, relative to the pigment, is notable. The studies are essentially limited to a coat application weight of 5 g/m$^2$ per page or side.

EP-0 377 983 A2 relates to a newsprint paper coated by means of an air brush or a roller coating device, which is said to have improved ink absorption, surface strength and opacity. Coat weights between 1 and 12 g/m$^2$, preferably between 3 and 8 g/m$^2$, per side to be printed are disclosed, whereby a total grammage of 60 g/m$^2$ is not exceeded. The filter content of the known coating base paper lies in the usual range of between 0.5 and 10% by weight, preferably, however, at less than 0.5% by weight.

In the "Paper Manufacturing Weekly" 1 (1988) pp. 1 to 6, the article "Surface Coated SC Papers, a Challenge for LWC Papers," relates to coating SC papers with a filler content of 15 to 25%. As the application device, an SDTA application system (short dwell time applicator) is reported. The application weights are in the range up to 3.5 g/m$^2$ per side, while in the case of coating base papers with a lower filler content of less than 10% by weight, higher application weights are required—for example, in the so-called LWC papers, a coating application weight of up to approx. 9 g/m$^2$ per side.

According to the article: "Possibilities for the On-Line Coating of Filled, Wood-Containing Papers" (*Möglichkeiten zum On-Line Streichen von gefüllten, holzhaltigen Papieren*) in the "Paper Manufacturing Weekly" 13 (1992), pp. 507–515, highly-filled upgraded SC papers are initially pretreated by means of a film press with a pigmentation consisting of calcium carbonate and at least 30% by weight binder, relative to the pigment, so that the papers have adequate strength to be coated with the actual top coat in a second workstep by means of a blade-coater. The top coats consist of mixtures of kaolin and fine calcium carbonate, whereby 12 parts by weight binder to 100 parts by weight pigment mixture are used. The minimum application quantity for the cover coat is 7 g/m$^2$ per side; by way of example, reference is made to application weights up to a total of 19 g/m$^2$, while for the pre-coat 4 to 5 g/m$^2$ are indicated.

Although the produced papers, which represent a new type of coated paper quality, have excellent characteristics in part, disadvantages exist insofar as the required double coat and the high weight of the top coat result in a paper which, due to its production costs, must remain excluded from significant areas of use. The article also describes in detail the disadvantages of film splitting at the output of a film press.

The article "Surface Treatment of Printing Papers containing AP—a Challenge on the Way to New Paper Qualities," ("*Oberflaechenbehandlung von AP-haltigen Druckpapieren—eine Herausforderung auf dem Weg zu neuen Papierqualitaeten*") published in the "Paper Manufacturing Weekly" 2 (1993), pp. 53 to 61, reports on various coating devices, including the film press known as the "speedsizer." Furthermore, in respect to the surface treatment of SC paper, a pigment layer of 4 to 5 g/m$^2$ is described as adequate to attain good gravure printing quality; however, it is noted in limitation of this that in the case of higher application weights to improve coverage and whiteness, a marked film splitting results when a speedsizer is used and leads to a drastic reduction in gloss. For this reason, a second coating step with a blade-coating device is considered useful in order to attain good gravure printing properties, although this admittedly results in increased machine expenditure and additional operating costs and thus makes the product more expensive.

Finally, the article "Experiences with Twin HSM in the Surface Finishing of Base Papers based on Waste Paper," ("*Betriebserfahrungen mit Twin HSM bei der Oberflaechenveredelung von Rohpapieren auf Altpapierbasis*"), published in the "Paper Fabrication Weekly" 21 (1993), pp. 886 to 890, reports on the problems associated with the use of a film press. This article also mentions high application weights; however, in respect to the type of applied coaters it discloses only that these were pigmented compositions.

SUMMARY AND DESCRIPTION OF THE INVENTION

The object of the present invention is to provide a web printing paper coated on both sides that can be manufactured under economical conditions, during the manufacture of which, in particular, no double coat is necessary, and the fiber material of which consists, as applicable, of recycled fibers, and the appearance and printability of which are comparable to the standard web printing papers on the market. In particular, the invention seeks to provide a web printing paper suitable for gravure printing.

To attain this object, the invention calls for a web printing paper coated on both sides, which consists of a coating base paper that contains mineral filler and, as its fiber components, wood pulp and/or cellulose, wherein the coating, which serves to absorb the printing ink contains pigment and binder, is applied by means of a film press. The paper is characterized by the fact that

- the coating base paper has a grammage of 30 to <58 g/m$^2$
- the filler content of the coating base paper, relative to its grammage, equals 15 to 35% by weight
- as desired, the coating base paper contains, in addition to wood pulp and/or cellulose, up to <50% by weight recycled fibers, and all weight parts add up to 100% by weight
- the coating on each side has a grammage of 2 to 12 g/m$^2$
- the pigment of the coating has a grain size for 40 to 60% by weight of <2 $\mu$m Before discussing in greater detail the advantages of the present invention, its further advantageous embodiments and the process for manufacturing the web printing paper according to the invention, the terms used in this application will be explained.

The web printing paper according to the invention refers exclusively to single-ply papers, in contrast to cardboard, for example.

Filler refers to the mineral pigments that are added to the fiber suspension during paper manufacture. No distinction is made here between freshly added fillers and fillers that are added to the paper manufacturing process, as applicable, together with fiber material recovered from waste paper.

Recycled fibers are fiber material recovered from waste paper; according to the invention, especially those fibers are preferred which are recovered from Waste Paper Category D31 on the list of German standard types.

De-inked recycled fibers are fibers from which the printing ink has been removed to the greatest extent possible.

Wood pulp refers to wood fibers mechanically reduced in size, i.e., to both the so-called groundwoods and to the types obtained with the help of refiners. A list of the various types of wood pulp is found in "Cellulose and Paper" (*Zellstoff and Papier*) 37 (1988), p. 212. Of the types of wood pulp listed there, the so-called TMP material (thermo-mechanical refiner wood pulp) is especially preferred according to the invention.

Wood pulp and cellulose refer to "fresh" fibers, in contrast to recycled fibers based on wood pulp or cellulose.

The term film press is used here to identify all devices in which a pre-dosing of the coater is carried out by means of dosing rollers, blades and smooth or ridged rolling blades on a transfer roller, from which the pre-dosed coater is "indirectly" transferred to the base paper web in order to form the coating. Further explanations are contained in the reference materials discussed above: "Paper Manufacturing Weekly" 13 (1992), pp. 507 to 515, as well as "Paper Manufacturing Weekly" 6 (1992), pp. 193 to 197.

Hot-soft calendars are also known in the profession as soft-compact calendars; the roll gap consists of a hot hard-cast roller and a roller connected thereto with resilient plastic; see also the "Paper Manufacturing Weekly" 16 (1990), pp. 701 to 708.

All weights of fiber materials, base papers, coated papers and coatings refer to "oven-dried" weights. Information on the binder relates to the solid content of the binder.

In order to determine the grain size of the pigment, one of the known sedimentation processes is used, e.g., pipette, sedigraph or Shimadzu centrifuge.

Preferably, the pigments present in the coating according to the invention are exclusively mineral pigments. Due to their relatively coarse grain distribution, such pigments have in the past been added as fillers to the fiber pulp during paper manufacture. The inventors have realized that when these coarse-grained pigments are used as coating pigments for a coater to be applied by means of a film press, so-called "film splitting" does not occur or at least occurs to a substantially reduced extent. As a result, a substantially smoother coated surface is created. The invention therefore makes it possible, even when highly pigmented coaters are used, to also apply substantially higher coating weights without problems. Good coverage of the surface of the coating base paper is possible with a single coat. The measures known from the prior art, such as the application of a preliminary coat by means of a film press and the subsequent application of a coat that serves to absorb the printing ink by means of a blade-coating device, can thus be dispensed with. Preferably, the pigment of the coat for 40 to 55% by weight has a grain size of <2 $\mu$m. As desired, the coating pigment can contain up to a maximum of 10% by weight (relative to the total pigment content) of one or more non-mineral pigments, e.g., non-dissolved starch granules.

In conjunction with the high filler content of the coating base paper of 15 to 35% by weight, particularly with coating application weights of more than 5 g/m$^2$ per side, a web printing paper of high opacity and good surface structure is created that can be printed by the offset as well as the gravure method. It is preferred that the pigment content of the coat, relative to the total fiber content of the coat, equals no less than 80% by weight; standard coater additives may be present in a subordinate maximum amount of 1.5% by weight. The use of a film press as the coating device makes it possible to reduce the coating base paper to 30 g/m$^2$. Furthermore, in conjunction with the pigment composition according to the invention of the coating that serves to absorb the printing ink, it is possible for the coating base paper to use, in addition to wood pulp and/or cellulose, up to a <50% by weight share of recycled fibers, preferably de-inked recycled fibers.

In terms of economics, the present invention thus offers, first, the advantage of saving on material costs by using the coating pigments according to the invention, which are more economical than the usual fine-part coating pigments. Furthermore, the advantage of reduced manufacturing costs is achieved by using only a single coating process. Finally, the invention also provides the advantage of being able to use recycled fibers to a considerable extent. The invention is not limited to the use of recycled fibers; rather, because of the reduced material and manufacturing costs, significant economic benefits are achieved even when the fiber material of the coating base paper consists solely of wood pulp and cellulose.

Furthermore, in order to ensure an even coated surface, it has proved advantageous for the coating pigments to have an average grain size in the range from 1.3 to 2.5 $\mu$m, while their BET surface lies between 6.5 and 9 m$^2$/g. Kaolin, calcium carbonate and talcum are preferred as suitable coating pigments. According to a further preferred embodiment, the coating pigment to be used according to the invention consists by more than 80% by weight of kaolin, calcium carbonate, talcum or a mixture of these coating pigments in the indicated grain size distribution, while the rest of the coating pigment may consist of the same pigments, but in finer distribution, or of other pigments, e.g., aluminum hydroxide, bentonite or titanium dioxide.

To attain especially good coverage of the base coating paper, a coating application of more than 5 g/m$^2$ per side is preferred; however, the application weight should not exceed 10 g/m$^2$ per side.

The binder content of the coat is based on the purpose for which the web printing paper according to the invention will be used. For a web printing paper to be printed using the dry offset method, a binder content of 12 to 20% by weight, relative to the pigment, is preferred. For the wet offset printing method, a binder content of 10 to 15% by weight is adequate. For a web printing paper to be printed by the gravure process, a binder content of 4 to 7% by weight, relative to the pigment, is called for according to the invention.

Specifically, the binders that can be used include the usual synthetic latexes based on acrylate and butadiene-styrene as well as binders based on starch, especially in the case of offset printing formulas; in this case, it is generally preferred that the binder as a whole consist largely of a synthetic latex. Only in the case of offset printing formulas with binder shares of more than 10% by weight can more than 50% by weight, but not more than 65% by weight, of binder based on starch be used.

In order to produce the web printing paper according to the invention, a coating base paper to which cationic starch is added during manufacture as a additive to improve strength has proved suitable. Preferably, the fillers of the coating base paper consist largely of kaolin, calcium carbonate and talcum or a mixture of these substances.

According to the invention, the manufacture of the web printing paper can take place on-line, i.e., the coating base paper, after drying, is fed directly to the film press for application of the coating and is directly glazed by means of a calendar, as applicable, even without intermediate winding following the application and drying of the coat. In this case, the calendar used may be a super calendar or a hot-soft calendar.

EXAMPLE

The following examples explain the invention:

In Examples 1 and 2, a wood-containing coating base paper with a grammage of 52 g/m$^2$ and a filler share of 31% by weight was coated in an experimental coating device equipped with a film press (application weight: 6 g/m$^2$ per side), dried and satinized on a super calendar.

Coater 1 (Example 1)

| | |
|---|---|
| Kaolin: 45% by weight < 2 μm | 100 parts by weight |
| Self-thickening acrylate latex | 5 parts by weight |
| Na stearate | 0.5 parts by weight |
| Solid content: | 40% by weight |

Coater 2 (Example 2)

| | |
|---|---|
| Kaolin as in Coater 1 | 60 parts by weight |
| Talcum 44% by weight < 2 μm | 40 parts by weight |
| Other components and solid content as in Coater 1. | |

A visual assessment of the web printed by the gravure method showed outstanding printing results.

We claim:

1. A web printing paper, comprising:

a coating base paper which contains mineral filler and at least one of wood pulp and cellulose as fiber components, the coating base paper having a grammage of 30 to <58 g/m$^2$, and a filler content, relative to its grammage, equal to 15 to 35% by weight, the coating base paper containing, in addition to the at least one of wood pulp and cellulose, up to <50% by weight recycled fibers, all weight parts adding up to 100% by weight; and a coating, applied to both sides of the base paper by a film press, for absorbing printing ink, the coating containing pigment and binder, the coating on each side of the base paper having a grammage of 2 to 12 g/m$^2$, 40 to 60% by weight of the pigment of the coating having a grain size of <2 μm, the pigment of the coating having an average grain size in a range of 1.3 to 2.5 μm.

2. A web printing paper according to claim 1, wherein 40 to 55% by weight of the pigment of the coating has a grain size of <2 μm.

3. A web printing paper according to claim 1, wherein the pigment of the coating consists essentially of one of the group consisting of kaolin, calcium carbonate, talcum and a mixture of these components.

4. A web printing paper according to claim 1, wherein the pigment of the coating comprises of more than 80% by weight of one of the group consisting of kaolin, calcium carbonate, talcum and a mixture of these components.

5. A web printing paper according to claim 1, wherein the coating has a grammage >5 g/m$^2$ to 12 g/m$^2$ per side of the base paper.

6. A web printing paper according to claim 5, wherein the coating has a grammage of >5 g/m$^2$ to 10 g/m$^2$ per side.

7. A web printing paper according to claim 1, wherein the coating contains 12 to 20% by weight binder relative to the pigment.

8. A web printing paper according to claim 1, wherein the coating contains 10–15% by weight binder relative to the pigment.

9. A web printing paper according to claim 1, wherein the coating contains 4–7% by weight binder relative to the pigment.

10. A process for producing a web printing paper coated on both sides, comprising the steps of:

providing a coating base paper which has a grammage of 30 to <58 g/m$^2$ and possesses a mineral filler content of 15–35% by weight, the coating base paper containing, in addition to at least one of wood pulp and cellulose, up to <than 50% by weight recycled fibers, all weight parts adding up to 100% by weight;

applying a coating to each side of the coating base paper, by means of a film press, in order to achieve a coating application weight with a grammage of 2–12 g/m$^2$ per side when dried;

drying the applied coating; and glazing the dried coating and paper with a calendar, the coating having a binder and a pigment wherein 40 to 60% by weight of the pigment has a grain size of <2 μm, the pigment having an average grain size in a range of 1.3 to 2.5 μm.

* * * * *